United States Patent [19]

Johnston

[11] 3,995,802

[45] Dec. 7, 1976

[54] BACK PACK SUITCASE

[76] Inventor: Brian Johnston, 1225 15th St., Santa Monica, Calif. 90404

[22] Filed: Nov. 10, 1975

[21] Appl. No.: 630,533

[52] U.S. Cl. ..... 224/8 R; 224/46 R; 190/60

[51] Int. Cl.[2] ..... A45F 3/04

[58] Field of Search ..... 224/8 R, 8 A, 25 A, 224/9, 10, 11, 12, 46 R, 47; 190/60, 26 R, 41 R

[56] References Cited

UNITED STATES PATENTS

| | | | |
|---|---|---|---|
| 2,781,113 | 2/1957 | Seeman | 190/60 |
| 2,823,971 | 2/1958 | Hoyt | 224/8 R X |
| 3,622,056 | 11/1971 | Droeger | 224/46 R X |

FOREIGN PATENTS OR APPLICATIONS

| | | | |
|---|---|---|---|
| 7,368 | 4/1900 | United Kingdom | 190/60 |

*Primary Examiner*—Robert J. Spar
*Assistant Examiner*—Jerold M. Forsberg
*Attorney, Agent, or Firm*—Ralph B. Pastoriza

[57] ABSTRACT

A suitcase is provided with shoulder straps in one of its broad sides so that the suitcase can be carried in the manner of a back pack. The straps are retractable into flat engagement with the broad side and the suitcase includes a handle permitting it to be carried in a conventional manner.

5 Claims, 4 Drawing Figures

BACK PACK SUITCASE

This invention relates generally to suitcases and more particularly, to a combination suitcase and shoulder strap arrangement permitting the suitcase to be carried in the manner of a back pack.

BACKGROUND OF THE INVENTION

Back packs per se, are well known in the art and generally include a tubular frame structure constructed of light-strong material so designed as to enable several items used in camping to be carried by one person on his back. Thus, a blanket roll, portable tent, shovel or similar digging equipment, food supplies, and so forth can normally all be accommodated on the back pack frame structure and fairly easily transported about. In this respect, all such back packs have left and right shoulder straps for securing the same to the wearer's back.

Conventional suitcases normally used by businessmen when traveling, on the other hand, are provided with a single carrying handle generally held with one hand. There are many instances in which a person with a relatively heavy suitcase must travel for a substantial distance on foot and it can become very tiring to hold the suitcase with the usual handle structure. More often than not, the traveler is shifting the heavy suitcase from one hand to the other as a consequence of the unbalanced load. Where a businessman or other person while traveling anticipates relatively long walks with his suitcase, he could, in lieu of the suitcase, utilize a conventional back pack but obviously such would be unsuitable not only from the standpoint of appearance, but as a matter of convenience when staying in hotels and the like.

BRIEF DESCRIPTION OF THE PRESENT INVENTION

With the foregoing considerations in mind, the present invention contemplates the provision of a modified suitcase so designed as to enable it to be carried in the manner of a back pack and yet without sacrificing the overall appearance of the same, all to the end that businessmen and executives can utilize the suitcase with perfect ease and yet in those instances wherein long walks with the suitcase are involved, the user can carry it in the manner of a back pack with all of the attendant conveniences.

Briefly, the invention comprises a parallelepiped shaped enclosure defining a suitcase, one broad side of the suitcase constituting a top lid providing access thereto and the opposite broad side constituting the bottom. A pair of shoulder straps extend from one of the broad sides exterior thereto adjacent the left and right end corners thereof, along the length of the broad side to terminate adjacent to the opposite left and right end corners. These shoulder straps in conjunction with the frame structure permit carrying of the suitcase in the manner of a back pack in a comfortable and convenient position.

In accord with further features of this invention, the broad side carrying the shoulder straps is padded to provide additional comfort for the user when carrying the suitcase on his back, the resilient padding conforming to the shape of the person's back. Further, the broad side of the suitcase for the straps is designed to incorporate retracting means so that the shoulder straps can be retracted flat against the broad side surface when not in use. The suitcase may then be carried with its usual handle in a conventional manner.

BRIEF DESCRIPTION OF THE DRAWINGS

A better understanding of this invention will be had by referring to one embodiment thereof as illustrated in the accompanying drawings in which.

DETAILED DESCRIPTION OF THE INVENTION

Figure 1:
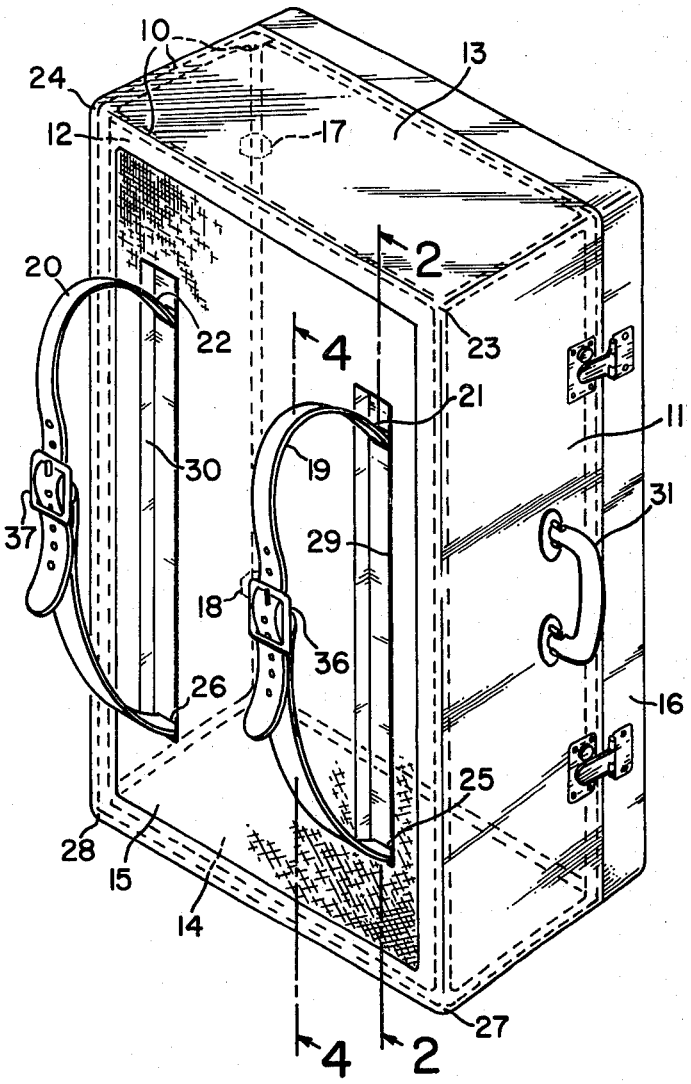
FIG. 1 is a perspective view of the back pack suitcase of this invention with the straps in withdrawn position preparatory to being carried in the manner of a back pack.

Referring first to FIG. 1, the back pack suitcase includes a parallelepiped shaped frame 10 supporting front, rear, side, and bottom panels to define a rigid suitcase enclosure. The front and rear panels are shown at 11 and 12 the side panels at 13 and 14, and the bottom panel at 15. A top lid 16 is hinged to the rear panel as indicated by the phantom lines at 17 and 18 in the usual manner.

In the foregoing construction of the suitcase, the top lid is in parallel spaced relationship with the bottom panel when closed, these top and bottom panels 16 and 15 constituting the broad sides of the suitcase.

As shown in FIG. 1, there are provided left and right shoulder straps 19 and 20 having initial portions 21 and 22 adapted to extend externally from one of said broad sides adjacent to the left and right end corners 23 and 24 thereof. In the particular embodiment illustrated, the straps 21 and 22 are on the bottom broad side or panel 15. It should be understood, however, that the straps could be formed in the top lid or panel 16 although the former construction shown in FIG. 1 is preferable.

As shown in FIG. 1, the left and right straps extend along the length of the broad side 15 adjacent the front and rear panels 11 and 12 to terminate in end portions 25 and 26 at points adjacent to the opposite left and right end corners 27 and 28 of the same bottom panel. The initial portions 21 and 22 of the straps and the end or terminal portions 25 and 26 are spaced apart a distance greater than one half the length of the suitcase or height of the suitcase as viewed in FIG. 1. For this reason, the initial portions 21 and 22 are referenced as being adjacent to the left and right corners 23 and 24 since they are closer to these corners than the opposite lower corners 27 and 28 as viewed in FIG. 1.

Preferably, the straps 19 and 20 are retractable in such a manner that they can lie flat against the bottom panel 15 when not in use. For this purpose, and in accord with the specific embodiment disclosed, the bottom panel 15 includes left and right shallow recesses 29 and 30 of width and depth corresponding approximately to the width and thicknesses of the shoulder straps. These channels extend between the points where the initial portions 21 and 22 of the straps pass from the bottom panel 15 to the terminal points 25 and 26.

It will be appreciated from the description thus far that with the straps 19 and 20 in the position shown in FIG. 1, the suitcase can easily be carried on a person's back in the manner of a back pack. Alternatively, when the straps 19 and 20 are retracted as will be described shortly, the handle 31 on the front panel 11 of the suitcase can be used to carry the suitcase in a conventional manner.

Figure 2:
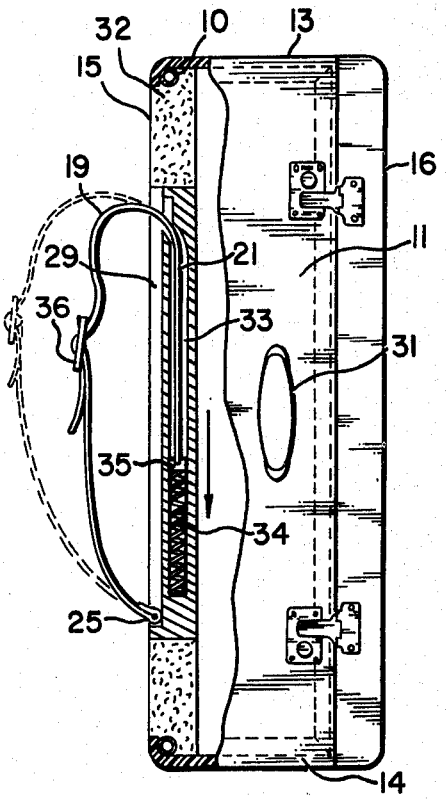
FIG. 2 is a fragmentary cross section of the back pack suitcase taken in the direction of the arrows 2—2 of FIG. 1 showing the straps partially retracted.

Referring now to FIG. 2, the retracting means for the straps will be described in detail. Since the retracting arrangement for each strap is identical, a description of one will suffice for both.

Thus referring to the cut-away portion of FIG. 2 it will be noted that the bottom panel 15 includes a resilient padding portion 32, this resilient padding extending over preferably the entire area of the bottom to serve as a cushion when the suitcase is worn in the manner of a back pack. Portions of the resilient pad 32 incorporate the retracting means for the straps, the specific retracting means for the strap 19 being shown as including an elongated channel 33 beneath the corresponding recess 29. The initial portion 21 of the strap 19 is arranged to loop back and pass into this channel as shown in FIG. 2. A spring means 34 in the end of the channel connects to the initial end portion 21 of the strap and exerts a pulling force on the strap tending to pull this initial portion into the channel. The length of the channel is such that when in retracted position, a portion of the strap is in the channel and the remaining portion lies flat in the corresponding recess.

In FIG. 2, the strap 19 is shown partially retracted from its fully extended dotted line position as illustrated into the channel 33.

Figure 3:
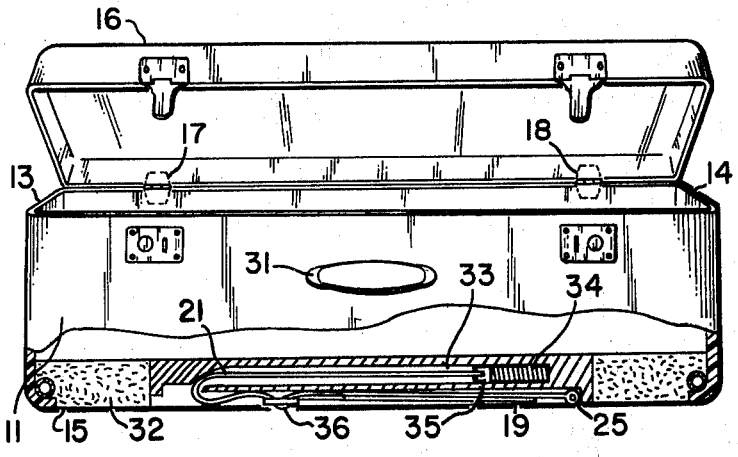
FIG. 3 is a front perspective view of the suitcase with the straps fully retracted and positioned for normal use, the lid of the suitcase being shown partially open.

Referring to FIG. 3, the strap is shown in its fully retracted position and the suitcase oriented in a manner to be packed or unpacked as is conventional.

In both FIGS. 2 and 3 it will be noted that the initial end 21 of the strap includes an enlargement 35 preventing its complete withdrawal from the associated channel. In this respect, the exit portion of the channel 33 is narrowed slightly so as to block the passage of the enlargement 35.

Since, however, different sized persons will utilize the back pack suitcase, it is desirable for the user to be able to adjust the overall length of the straps when in fully extended positions. Towards this end, there may be provided a simple buckle structure such as indicated at 36 and 37 in FIG. 1 for the respective left and right shoulder straps.

Each of the buckle structures which constitute an adjustment means for varying the overall length of the strap is identical and thus description of one will suffice for both.

Figure 4:
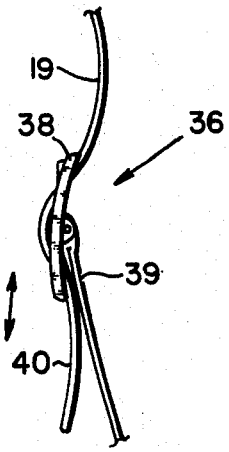
FIG. 4 is an enlarged fragmentary portion of one of the straps taken in the direction of the arrows 4—4 of FIG. 1.

Referring specifically to FIG. 4, there is shown the buckle structure 36 which includes a simple buckle 38 which may be similar to a normal trouser belt buckle secured to an end 39 of the strap extending from the lower terminal point 25. The upper portion of the strap 19 itself then is passed through the buckle and can be adjustably secured to the buckle at various points in the manner of a belt. The free end of the strap 19 in the fastening arrangement described is shown at 40 in FIG. 4 and the adjustment is indicted by the double headed arrow.

It is to be appreciated that any other suitable adjusting means may be provided for varying the length of each of the shoulder straps. The particular structure shown is made large for purposes of clarity. Normally, any such adjusting means would be easily accommodated within the respective shallow recesses 29 and 30 when the straps are fully retracted.

From the foregoing description, it will be evident that the present invention has provided a novel suitcase construction which provides a means for carrying clothes or other items either as is conventionally done with a normal suitcases or on a person's back in the manner of a back pack wherein long distances must be travelled on foot with the suitcase.

Minor modifications falling clearly within the scope and spirit of this invention will occur to those skilled in the art. The back pack suitcase is therefore not to be thought of as limited to the specific embodiment set forth merely for illustrative purposes.

What is claimed is:

1. A back pack suitcase comprising, in combination:

a. parallelepiped shaped enclosure defining a suitcase, one broad side of the suitcase constituting a top lid providing access thereto and the opposite broad side constituting the bottom, said bottom including resilient padding over a portion of its area to cushion the surface against a person's back when carried in the manner of a back pack; and, b. a pair of shoulder straps extending from one of said broad sides exterior thereto adjacent to left and right end corners thereof along the length of the broad side to terminate adjacent to the opposite left and right end corners to thereby provide means for carrying said suitcase in the manner of a back pack; and c. retractable means in said bottom for collapsing said straps into flat engagement with the bottom when not in use, said suitcase including a handle so that it may be carried in one hand in a conventional manner.

2. A back pack suitcase comprising, in combination:

a. a parallelipiped shaped frame supporting front, rear, side, and bottom panels to define a rigid suitcase enclosure;

b. a top lid hinged to the rear panel and in parallel spaced relationship to the bottom panel when closed, the top and bottom panels constituting the broad sides of the suitcase;

c. left and right shoulder straps having initial portions adapted to extend exteriorally from one of said broad sides adjacent to the left and right end corners thereof, said straps extending along the length of the broad side adjacent the front and rear sides respectively to terminate in end portions in said same broad side at points adjacent to the opposite left and right end corners thereof, said one broad side including resilient padding over substantially its entire area; and, d. retractable means incorporated in said one broad side and coupled to the initial portions of said straps so that the straps may be collapsed flat against the surface of said one broad side when not in use.

3. A back pack suitcase according to claim 2, in which said one broad side constitutes the bottom panel of the suitcase, said bottom panel including left and right shallow recesses of width and depth corresponding approximately to the width and thickness of the shoulder straps and extending between the points the straps are coupled to the bottom panel, said retracting means including for each strap: an elongated channel in said bottom panel beneath a corresponding recess, the initial portion of the associated strap looping back to pass into said channel; and spring means in the end of the channel exerting a pulling force on the strap tending to pull its initial portion into the channel so that when in retracted position a portion of the strap is in said channel the remaining portion lying flat in the corresponding recess.

4. A back pack suitcase according to claim 3 in which the initial portion of each strap includes an enlargement preventing its complete withdrawal from its associated channel, each strap further including adjustment means for changing its overall length.

5. A back pack suitcase according to claim 4 including a carrying handle on said front panel for said suitcase.

* * * * *